US008960291B2

(12) United States Patent
Parsche

(10) Patent No.: US 8,960,291 B2
(45) Date of Patent: Feb. 24, 2015

(54) METHOD FOR FORMING A HYDROCARBON RESOURCE RF RADIATOR

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 267 days.

(21) Appl. No.: 13/426,160

(22) Filed: Mar. 21, 2012

(65) Prior Publication Data

US 2013/0248185 A1 Sep. 26, 2013

(51) Int. Cl.
*E21B 43/24* (2006.01)

(52) U.S. Cl.
USPC ..... 166/302; 166/60; 166/61

(58) Field of Classification Search
USPC ..... 166/60, 61, 302, 248
See application file for complete search history.

(56) References Cited

U.S. PATENT DOCUMENTS

| | | | | |
|---|---|---|---|---|
| 3,702,493 | A * | 11/1972 | Murphy | 29/592.1 |
| 4,793,409 | A * | 12/1988 | Bridges et al. | 166/57 |
| 4,817,711 | A * | 4/1989 | Jeambey | 166/248 |
| 4,819,723 | A | 4/1989 | Whitfill et al. | |
| 5,055,180 | A | 10/1991 | Klaila | |
| 5,199,488 | A | 4/1993 | Kasevich et al. | |
| 7,115,847 | B2 | 10/2006 | Kinzer | |
| 7,288,690 | B2 | 10/2007 | Bellet et al. | |
| 2006/0227663 | A1 * | 10/2006 | Clark et al. | 367/82 |
| 2006/0283598 | A1 * | 12/2006 | Kasevich | 166/302 |
| 2007/0137858 | A1 | 6/2007 | Considine et al. | |
| 2009/0040687 | A1 * | 2/2009 | Oakes et al. | 361/313 |
| 2009/0139714 | A1 * | 6/2009 | Prather | 166/250.15 |
| 2009/0283257 | A1 | 11/2009 | Becker | |
| 2010/0218940 | A1 | 9/2010 | Parsche | |
| 2010/0219105 | A1 | 9/2010 | Parsche | |
| 2010/0219107 | A1 | 9/2010 | Parsche | |
| 2010/0219108 | A1 | 9/2010 | Parsche | |
| 2010/0219182 | A1 | 9/2010 | Parsche | |
| 2010/0219184 | A1 | 9/2010 | Parsche | |
| 2010/0223011 | A1 | 9/2010 | Parsche | |
| 2010/0311936 | A1 * | 12/2010 | Smith et al. | 528/44 |

FOREIGN PATENT DOCUMENTS

| | | |
|---|---|---|
| WO | 2007147050 | 12/2007 |

* cited by examiner

*Primary Examiner* — David Andrews
*Assistant Examiner* — Taras P Bemko
(74) *Attorney, Agent, or Firm* — Allen, Dyer, Doppelt, Milbrath & Gilchrist, P.A.

(57) ABSTRACT

A method for forming a radio frequency (RF) radiator in a laterally extending wellbore in a subterranean formation containing a hydrocarbon resource may include positioning at least one electrically conductive member within the laterally extending wellbore. The method may also include supplying a solidifiable material adjacent the at least one electrically conductive member, and solidifying the solidifiable material to form a dielectric material layer over the at least one electrically conductive member to form the RF radiator.

18 Claims, 6 Drawing Sheets

METHOD FOR FORMING A HYDROCARBON RESOURCE RF RADIATOR

FIELD OF THE INVENTION

The present invention relates to the field of hydrocarbon resource processing, and, more particularly, to hydrocarbon resource processing methods.

BACKGROUND OF THE INVENTION

A hydrocarbon resource may be particularly valuable as a fuel, for example, gasoline. One particular hydrocarbon resource, bitumen, may be used as a basis for making synthetic crude oil (upgrading), which may then be refined into gasoline. Accordingly, bitumen, for example, may be relatively valuable. More particularly, to produce 350,000 barrels a day of bitumen based synthetic crude oil would equate to about 1 billion dollars a year in bitumen. Moreover, about 8% of U.S. transportation fuels, e.g., gasoline, diesel fuel, and jet fuel, are synthesized or based upon synthetic crude oil.

In the hydrocarbon upgrading or cracking process, hydrogen is added to carbon to make gasoline, so, in the case of bitumen, natural gas is added to the bitumen. Natural gas provides the hydrogen. Bitumen provides the carbon. Certain ratios and mixes of carbon and hydrogen are gasoline, about 8 carbons to 18 hydrogens, e.g. $CH_3(CH_2)_6CH_3$. Gasoline is worth more than either bitumen or natural gas, and thus the reason for its synthesis.

Synthetic fuel is manufactured in upgraders and refineries at the surface, after the bitumen resource is extracted from the earth. Bitumen is usually strip mined or extracted by wells using enhanced oil recovery technologies (EOR), such as, steam assist gravity drainage (SAGD). Strip mining may be undesirable for environmental reasons and typically only those deposits near the surface are economic. SAGD may be undesirable because of its relatively slow speed, unreliable startup, payzone caprock integrity to include the steam, steam loss due to thief zones and wormholes, and stranded pay zones due to impermeable layers. Enhanced oil recovery by radio frequency well heating may be impacted less from these limitations and may be three or more times faster for increased value and profit. Unlike conducted heating, RF heating energy may instantaneously penetrate many feet.

Hydrocarbon reservoirs often include water. A hydrocarbon rich oil sand, from the Athabasca Province of Canada is, for example, a porous microstructure having sand grains in a water pore, surrounded by a bitumen fill. Analysis by the Alberta Research Council indicates the weight proportions of rich sand is between 14-16 percent bitumen, 0.5 to 2.0 percent water, and the remainder sand and clay. A lean oil sand may include 5 to 10 percent bitumen (or less of course), and 6 to 9 percent water. Hydroxyl radicals are typically present in the water, and salts and dissolved carbon dioxide may present, so the connate waters and ores have a range of electrically conductivity. Dissolved carbon dioxide may form a weak solution of carbonic acid, which is a conductive electrolyte. At 1 MHz radio frequency, the electrical conductivity of the rich oil sand may be 0.002 mhos/meter, and a lean oil sand 0.2 mhos per meter, so reduced hydrocarbon content may mean increased moisture and increased electrical conductivity. The electrical nature of oil sand also changes as the material is heated.

Several references disclose application of RF to a hydrocarbon resource to heat the hydrocarbon resource, for example, for cracking. In particular, U.S. Patent Application Publication No. 2010/0219107 to Parsche, which is assigned to the assignee of the present application, discloses a method of heating a petroleum ore by applying RF energy to a mixture of petroleum ore and susceptor particles. U.S. Patent Application Publication Nos. 2010/0218940, 2010/0219108, 2010/0219184, 2010/0223011, 2010/0219182, all to Parsche, and all of which are assigned to the assignee of the present application disclose related apparatuses for heating a hydrocarbon resource by RF energy. U.S. Patent Application Publication No. 2010/0219105 to White et al. discloses a device for RF heating to reduce use of supplemental water added in the recovery of unconventional oil, for example, bitumen.

Several references disclose applying RF energy at a particular frequency to crack the hydrocarbon resource. U.S. Pat. No. 7,288,690 to Bellet et al. discloses induction heating at frequencies in the range of 3-30 MHz. More particularly, radio frequency magnetic fields are applied to ferrous piping that includes hydrocarbons. The magnetic fields induction heat the ferrous piping and the hydrocarbons inside are warmed conductively. Application Publication No. 2009/0283257 to Becker discloses treating an oil well at a frequency range of 1-900 MHz and no more than 1000 Watts, using a dipole antenna, for example.

U.S. Pat. No. 7,115,847 to Kinzer discloses a method of capacitive RF heating using impedance matching techniques to increase efficiency of hydrocarbon resource recovery. More particularly, Kinzer discloses setting a signal generating unit to an initial frequency and changing the frequency based upon a load impedance.

U.S. Pat. No. 4,819,723 to Whitfill et al. discloses a method of reducing the permeability of a rock formation to address the problem of fluid loss to highly porous subterranean formation. Whitfill et al. discloses pumping an emulsion including an alkali metal silicate, i.e. sodium silicate, into a well in the subterranean formation. A microwave generator is lowered into the well via a cable until it is adjacent a permeable zone. Microwave energy is applied into the permeable zone to cause the emulsion to break and release the sodium silicate. The released sodium silicate, upon contact with brine in the permeable zone, forms a plug of gel to block the remainder of the zone from the well.

Further improvements to hydrocarbon resource recovery, or heating or upgrading may be desirable. For example, it may be desirable to increase the efficiency of startup of an uninsulated well by making it quicker and cheaper, for example.

SUMMARY OF THE INVENTION

In view of the foregoing background, it is therefore an object of the present invention to increase the efficiency of hydrocarbon resource recovery.

This and other objects, features, and advantages in accordance with the present invention are provided by a method for forming a radio frequency (RF) radiator in a laterally extending wellbore in a subterranean formation containing a hydrocarbon resource. The method includes positioning at least one electrically conductive member within the laterally extending wellbore and supplying a solidifiable material adjacent the at least one electrically conductive member. The method also includes solidifying the solidifiable material to form a dielectric material layer over the at least one electrically conductive member to form the RF radiator. Accordingly, the method may increase efficiency of hydrocarbon resource recovery by electrically isolating the RF radiator, for example, to reduce losses during startup.

The solidifiable material may be solidified by supplying direct current (DC) power to the at least one conductive member. The solidifiable material may be solidified by supplying direct current (DC) power to at least one of a plurality of electrically conductive members, for example.

At least one electrically conductive member may include a well pipe. The at least one electrically conductive member may further include an electrical conductor extending along the well pipe, for example. The solidifiable material may be solidified by supplying direct current (DC) power to the electrical conductor. Supplying DC power to the electrical conductor may include supplying DC power to an electrical conductor spirally wound along the well pipe.

The solidifiable material may be solidified by positioning a catalyst into the laterally extending wellbore. The solidifiable material may be an alkali metal silicate. The solidifiable material may include at least one of sodium silicate, magnesium silicate, and potassium silicate, for example.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
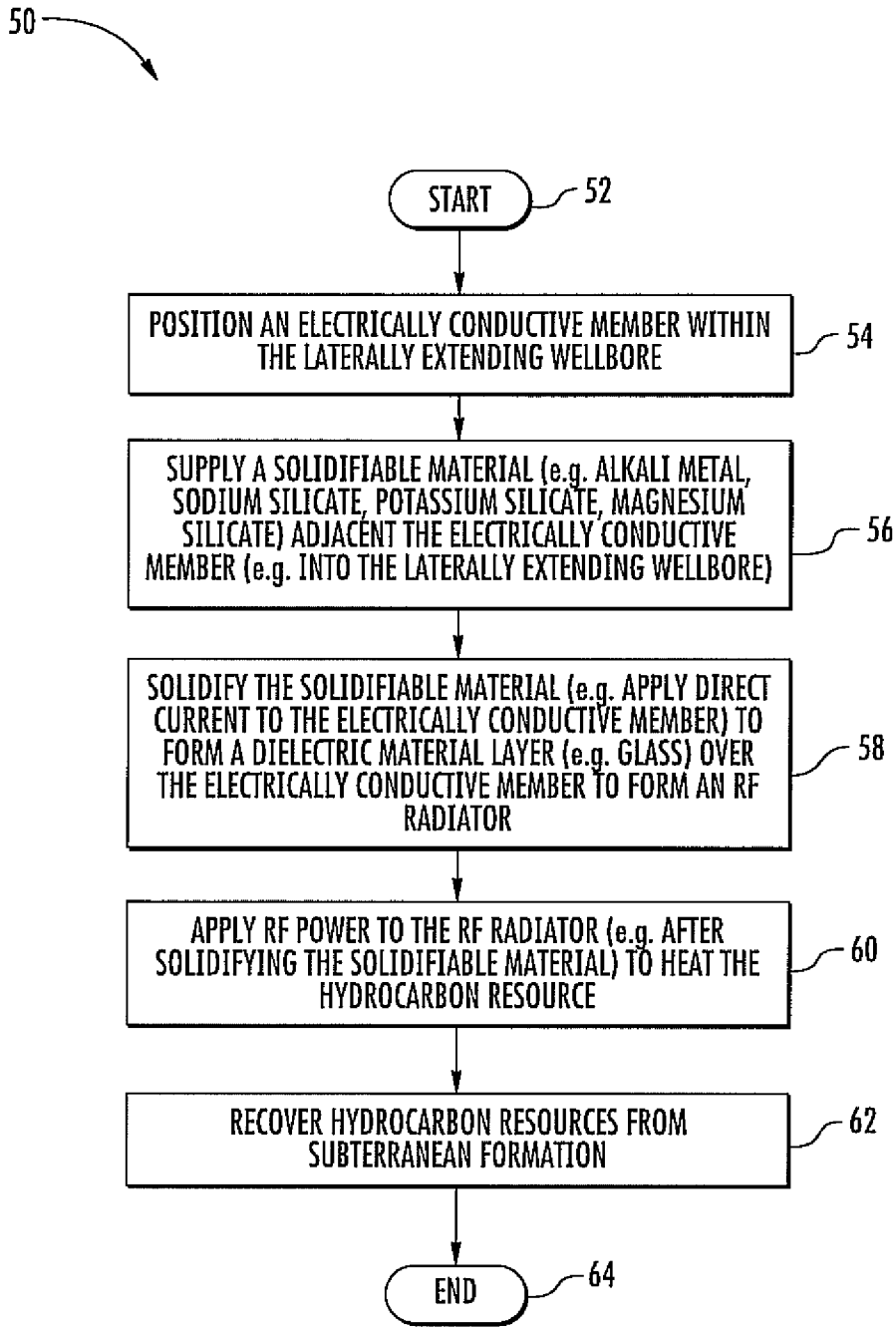
FIG. 1 is a flow chart of a method of recovering a hydrocarbon resource in accordance with the present invention.
Figure 2:
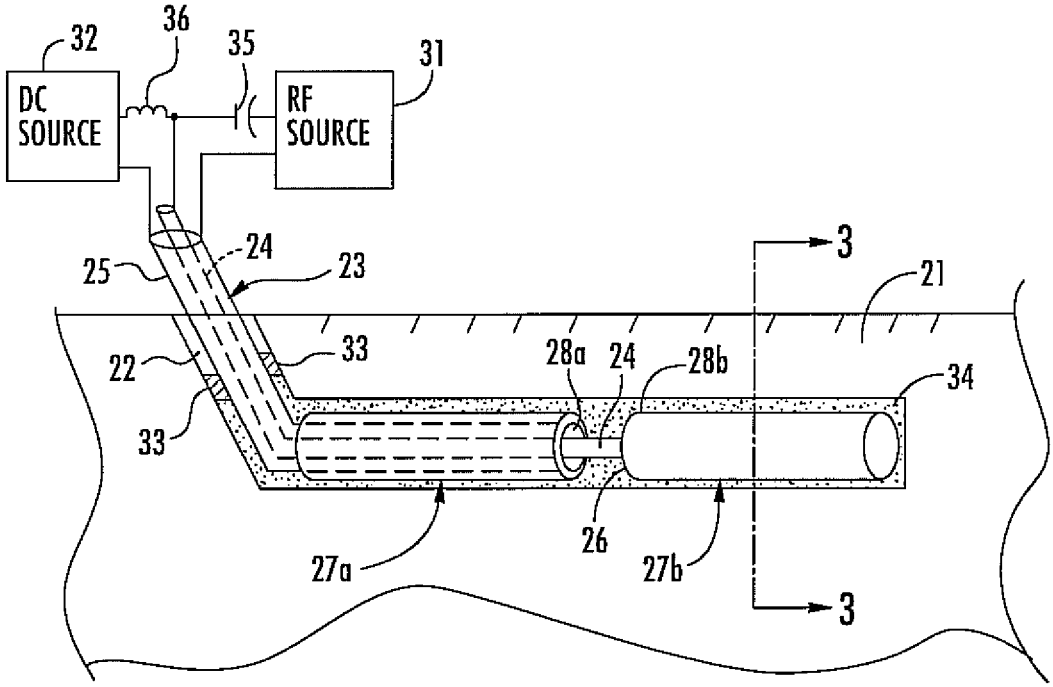
FIG. 2 is a schematic cross-sectional view of a subterranean formation including an electrically conductive member for use with the method illustrated in the flowchart of FIG. 1.
Figure 3:
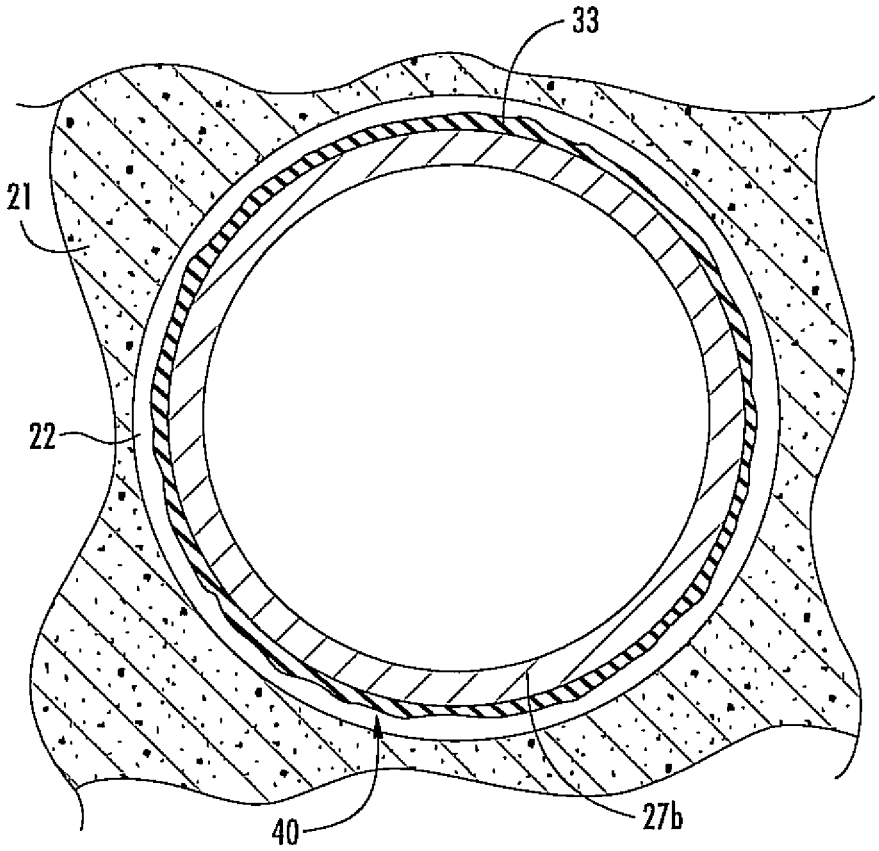
FIG. 3 is an enlarged schematic cross-sectional view of a subterranean formation including a portion of the electrically conductive member of FIG. 2 taken along line 3-3.

Referring initially to the flowchart 50 in FIG. 1, and FIGS. 2 and 3, a method for forming a radio frequency (RF) radiator 40 in a laterally extending wellbore 22 in a subterranean formation 21 containing a hydrocarbon resource and connate water is illustrated. Starting at Block 52, the method includes positioning an electrically conductive member 23 within the laterally extending wellbore (Block 54).

The electrically conductive member 23 may be in the form of an inset feed dipole antenna, for example (FIG. 2). The electrically conductive member 23 includes an inner conductor 24 and outer conductor 25 defining a coaxial conductor shielded transmission line. Other embodiments may include multiple inner conductors 24 within the outer conductor 25, for example, one or more insulated wires in metal conduit. The outer conductor 25 advantageously reduces unwanted heating at the surface or in the overburden. A balun 33, such as a ferrite collar, for example, may also be included around the outer conductor 25 to assist in reducing unwanted heating in regions other than the payzone by common mode currents.

The outer conductor 25 couples to a first metal pipe 27*a* to define a first feed point 28*a*. The inner conductor 24 extends beyond the outer conductor 25 in the laterally extending wellbore 22 and couples to an annular plate 26 of a second metal pipe 27*b* adjacent the first metal pipe 27*a* to define a second feed point 28*b*. The first and second metal pipes 27*a*, 27*b* are spaced apart and define dipole half elements.

Because the electrically conductive member 23 includes bare metallic material, insulation may be desired. However, insulation is typically not present, especially on legacy pipes, for example, and providing insulation for newer installations may be relatively costly or impractical. Thus, the first and second metal pipes 27*a*, 27*b* act like electrodes as they are in contact with the connate water in the laterally extending wellbore 22. This connate water may cause the electrically conductive member 23 to have a low resistance and be inductively reactive. For example, at a 113 kilohertz frequency, the impedance of a 1 kilometer center fed bare dipole electrically conductive member 23 is about Z=8+j6.5 ohms immersed in rich Athabasca oil sand having a 0.002 mhos/meter electrical conductivity. When insulated, the same electrically conductive member 23 would have an impedance near Z=63+j0 ohms. Thus, nonconductive insulation can beneficially increase load resistance, reduce current and conductor gauge requirements, provide resonance, increase power factor, and reduce standing wave transmission line ringing. All of these factors may increase system efficiency.

The first and second pipes 27*a*, 27*b* supply conducted currents to the subterranean formation 21, which may be an oil sand formation, for example. The electrically conductive member 23 or antenna exhibits low resistance. Increasing the size of the electrically conductive member 23 may be uneconomical or impractical based upon increased current requirements, for example, or due to voltage standing wave ratio (VSWR). While the electrically conductive member 23 described herein may define an inset feed dipole antenna, other types of antennas in other configurations may be used.

Additionally, adding an electrical insulator, for example, may be increasingly difficult as the electrical insulator would endure temperatures of up to 260° C. Moreover, an insulating coating on the first and second pipes 27*a*, 27*b*, and/or the electrical conductor 23, for example, may be impractical, as they may be handled relatively roughly during transportation and installation. Many high temperature insulating materials are weak in tension or brittle, or have other properties that may be undesirable for installation. Thus, it may be desired to form an electrical insulator over the electrically conductive member 23 in situ.

The method further includes, at Block 56, supplying a solidifiable material 34 adjacent the electrically conductive member 23, and, more particularly, into the laterally extending wellbore 22. The solidifiable material 34 is preferably, an alkali metal silicate, and more particularly, sodium silicate. A solution of sodium silicate, for example, becomes glass, an electrical insulator, at the boiling point of water. Thus, sodium silicate can be used as a glass coating. The glass coating can withstand relatively high temperatures and water for a relatively long period of time. For example, sodium silicate is typically used in chimneys, and may be an effective high-temperature sealant. Sodium silicate is also relatively inexpensive and may be considered environmentally friendly. Of course, other solidifiable materials and/or electrically insulating may be used, for example, potassium silicate or magnesium silicate or siloxane. In some embodiments the solidifiable material may be a thermosetting polymer such as polymide, polyamide, or phenol, solidified by polymerization.

At Block 58, the method also includes solidifying the solidifiable material 34 to form a dielectric material layer 33 over the electrically conductive member 23 to form the RF radiator 40 (FIG. 3). The solidifiable material 34 may be solidified by applying direct current (DC) power to the electrically conductive member 23 so that it reaches its boiling point to form the dielectric material layer 33. For example, in the case of sodium silicate, DC current may be supplied to the electrically conductive member 23 to heat the sodium silicate so that it forms a dielectric layer of glass over the electrically conductive member 23 to form the RF radiator 40 (FIG. 3). The DC current is supplied from a DC current source 32 positioned above the subterranean formation 21 and coupled to the electrically conductive member 23. The DC current source 32 may include a regulator, such as a current or a voltage regulator, to manage the charging currents in to the subterranean formation 21 when the current is first applied, or to manage heating rates.

The DC current source 32 may be connected in parallel with an RF source 31. A capacitor 35 may block or reduce DC current from reaching the RF source 31 and an inductor 36 may block or reduce RE current from reaching the DC current source 32. Alternatively, a single pole double throw switch may be used between the capacitor 35 and the inductor 36 to allow the DC current 32 and the RE source 31 to be applied at different times to the RF radiator 40. Down hole, the DC currents create film boiling, e.g. a Leidenfrost Effect vapor layer, at the surface of the electrically conductive member 23 to electrically insulate electrically conductive member from the subterranean formation 21. The water vapor insulation may be formed and maintained by applying and maintaining the DC electric potential.

In the case of sodium silicate, the flow of current provides joule effect ($I^2R$) heating of the sodium silicate solution 34, and, at the boiling point temperature at reservoir pressure, glass forms on the surface of the electrically conductive member 23. The DC heating causes film boiling, which drives the sodium silicate to precipitate the glass layer or coating. Once the glass forms in place, the electrically conductive member 23 is electrically insulated from the subterranean formation 21, and DC power may be turned off.

Of course, other heating or other techniques may be used to solidify the solidifiable material 34. For example, in some embodiments, a catalyst may be supplied within the laterally extending wellbore 22. The catalyst may react with the solidifiable material 34 to generate the heat to form the dielectric material layer 33. Of course, other types of catalysts may be used to form the dielectric layer 33. RF, from an RF source 31, may also be used in some embodiments to heat or solidify the solidifiable material 34.

RF power is preferentially supplied to the RF radiator 40 after solidifying the solidifiable material 34 (Block 60). The RF power is supplied from an RF source 31 positioned above the subterranean formation 21 and coupled to the electrically conductive member 23. The RF power advantageously heats the hydrocarbon resources in the subterranean formation 21 as will be appreciated by those skilled in the art. This may be accomplished without conductive electrical contact with the subterranean formation 21.

Indeed, while the solidifiable material 34 is supplied prior to heating via the supply of RF power, it should be understood that that solidifiable material may be supplied or resupplied at any time in the hydrocarbon resource recovery process, for example, during or after RF heating.

At Block 62, the hydrocarbon resources are recovered from the subterranean formation. The hydrocarbon resources may be recovered using conventional techniques, for example, a pump may be used to recover the hydrocarbon resources. Other hydrocarbon resource recovery techniques may be used with the method embodiments described herein, for example, steam assisted gravity drainage (SAGD). Of course, a second laterally extending wellbore positioned below the laterally extending wellbore 22 may be formed, and the hydrocarbon resources may be recovered therefrom. The method ends at Block 64.

Of course, in some embodiments it may also be possible to resistively heat the electrically conductive member 23 instead of resistively heating the solidifiable material 34 to solidify the solidifiable material. For instance, the RF radiator 40 may be in the form of a folded dipole antenna to provide a DC closed circuit through the electrically conductive member 23, and DC currents conducted through the RF radiator 40 may heat the metal conductors by joule effect. Nucleate boiling at the surface of a resistively heated RF radiator 40 precipitate the silica glass from a sodium silicate—water solution solidifiable material 34.

Figure 4:
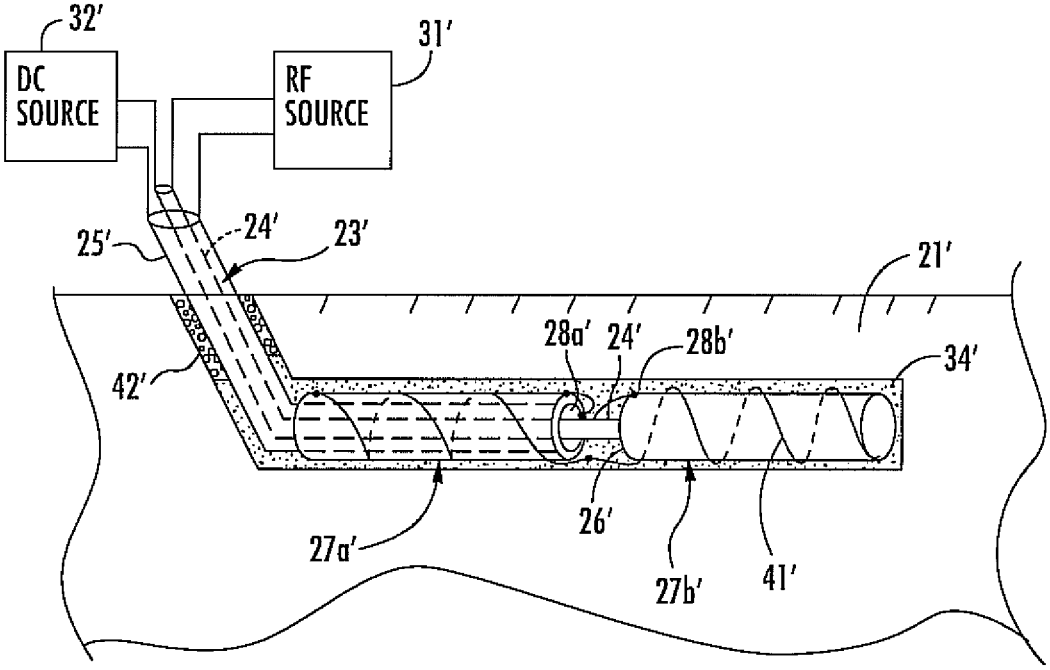
FIG. 4 is a schematic cross-sectional view of a subterranean formation including an electrically conductive member and an electrical conductor according to another embodiment for use with the method illustrated in the flowchart of FIG. 1.

Referring now to FIG. 4, in another embodiment, an electrical conductor 41' may be wound, for example, spirally, around the electrically conductive member 23', and more particularly, the first and second pipes 27*a*', 27*b*'. The electrical conductor 41' is coupled to the DC source 32' and is configured to generate the conduction heating to solidify the solidifiable material 34'. The RF source 31' may remain coupled to the electrically conductive member 23'.

The electrical conductor 41' may be in the form of a relatively thin insulated wire, such as a nichrome wire, for example. The inductance of the electrical conductor 41' wound around of the electrically conductive member 23' may make the electrical conductor 41' an open circuit at radio frequency (RF), similar to an RF choke. This may reduce an amount of interference the electrically conductive member 23' has when operating as an RF radiator, so the electrical conductor 41' can be paralled with the RF radiator. The electrical conductor 41' may, in some embodiments, also include fusible links that may be burned open by a relatively high current DC pulse to open the electrical conductor for use during RF heating. The DC film boiling may even insulate the electrically conductive member 23' with a reduced amount of solidifiable material 34'.

Additionally, a ferrite-cement casing 42' may be positioned in the upper part of the wellbore 21'. The ferrite-cement casing 42' may be positioned after supplying the solidifiable material 34', for example, and may further control placement of the solidifiable material to areas of the wellbore 22' adjacent the hydrocarbon resource. The ferrite-cement casing 42' may function as a common mode current choke to reduce the flow of RF currents into regions where heating is undesired.

Figure 5:
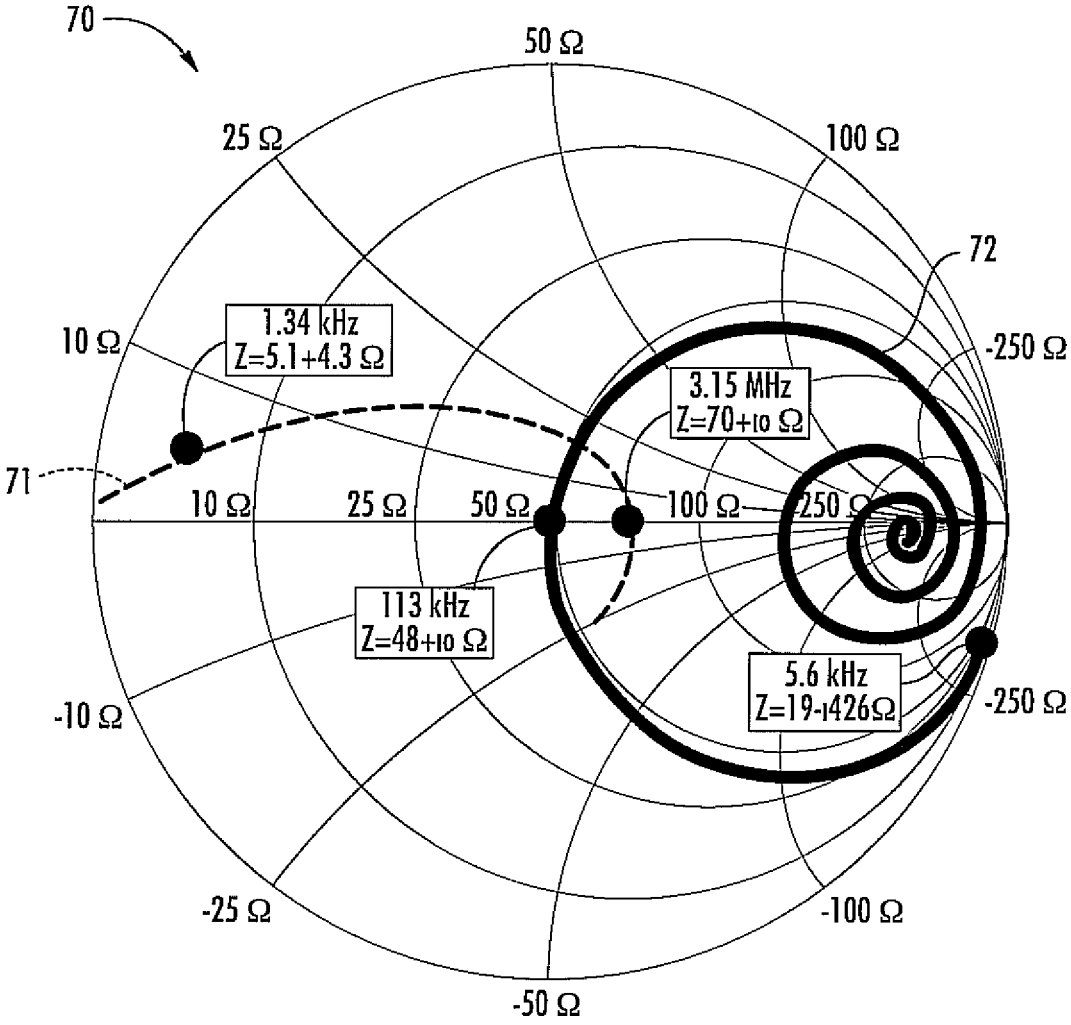
FIG. 5 is a Smith Chart of driving point RF impedance of an example subterranean dipole RF radiator according to the present invention.

Referring now additionally to the graph 70 in FIG. 5, an example of the electrical benefits of the present embodiments will now be provided. The graph 70 illustrates the driving point RF impedance of a center fed dipole RF radiator 40 with and without (lines 71 and 72, respectively) the dielectric material layer 33. The analysis was obtained by numerical electromagnetic modeling software. A 1000 meter long center fed dipole type electrically conductive member 23 was modeled, e.g. two dipole half elements 500 meters long that were electrically active. The dipole elements were cylinders 0.2 meters in diameter and made of perfect electrical conductor (PEC). The subterranean formation 21 had an electrical conductivity of 0.002 mhos per meter and a relative dielectric permittivity of 8 (relative permittivity is dimensionless), as may be typical of bitumen rich Athabasca oil sand from the region of Fort McMurray, Canada. The dielectric material layer 33 was a 0.1 meters thick around the dipole half elements and modeled with an electrical conductivity of $10^{-8}$ mhos/meter. The dipole fundamental resonant frequency was 3.15 MHz without the insulation and 0.133 MHz with the insulation. Boiling the water off with RF current and tracking the dipole resonance frequency may require a 3.15/0.133=24 to 1 frequency range. The operative advantages of providing the dielectric material layer 33 may include a first resonance at a lower radio frequency. In the example, the resonance was at 0.133 MHz insulated versus of 3.15 MHz uninsulated. RF heating at a lower resonant frequency reduces transmission line losses and increases penetration into the subterranean formation 21.

Another operative advantage of providing the dielectric material layer 33 may be that the tuning requirements for the RF power source 31 may be reduced. Once the dielectric material layer 33 has formed, the resonance frequency of the RF radiator 40 is relatively stable even as the heating of the subterranean formation 21 progresses and hydrocarbons are produced. In a field test, a 20 meter long insulated RF radiator 40 was operated near 6.78 MHz at 108 kilowatts incident power in Athabasca oil sand. The resonance frequency drifted less than 5 percent over the 3 week test period. The direction of the drift was mostly upwards in frequency. Tracking the resonance frequency of the electrically conductive member 23 with the RF source 31 greatly reduces transmission line losses by improving power factor and reducing voltage standing wave ratio (VSWR).

Figure 6:
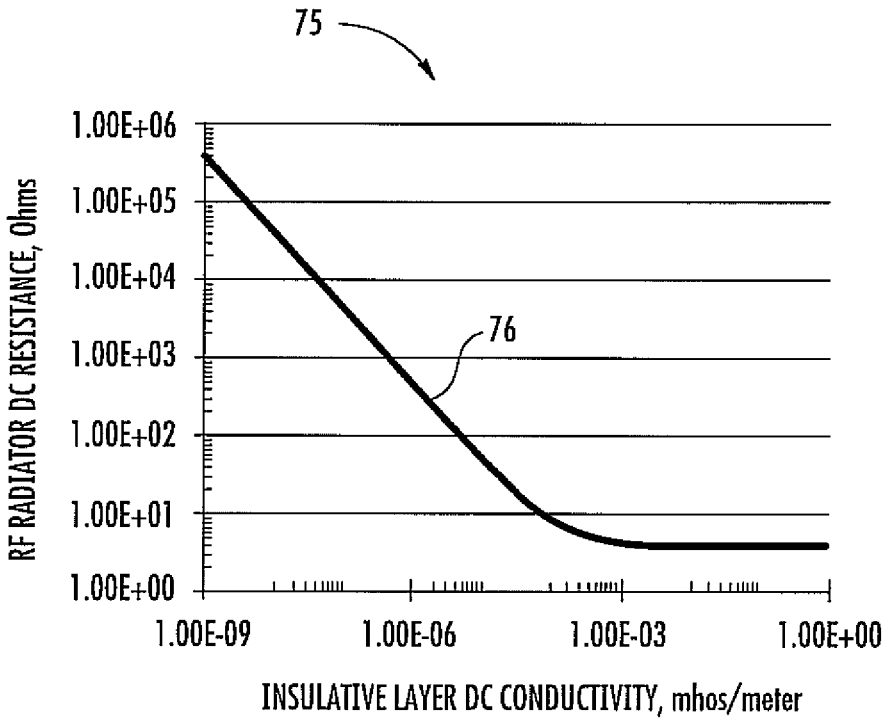
FIG. 6 is a graph of driving point DC resistance of an example subterranean dipole RF radiator according to the present invention.

Referring now to the graph 75 in FIG. 6, the calculated DC resistance 76 at the dipole center/driving point of the example 1000 meter long dipole RF radiator 40 is illustrated as a function of the electrical conductivity of the dielectric layer 33. When insulation is not present, the RF radiator 40 is akin to an electrode pair and the dipole driving resistance may be relatively low, approximately 3.7 ohms at DC/zero hertz in the example. However, when the dielectric material layer 33 is present the DC resistance may rise greatly. The amount of the resistance rise may depend on the conductivity of the dielectric material layer 33. If sodium silicate is not present, the amplitude and duration of the applied DC current may form a dielectric layer 33, comprised of a steam saturation zone due to film boiling/a Leidenfrost Effect vapor layer at the surface of the electrically conductive member 23. The conductivity of this vapor layer, and the DC resistance rises as a function of steam quality.

If sodium silicate is present, the amplitude and duration of the applied DC current may form a dielectric layer 33 including a silica glass at the surfaces of the electrically conductive member 23, plus a Leidenfrost Effect vapor layer. The conductivity of this glass layer may be a function of integrity of the glass structure/silica frosting and the amount of alkali metal ions remaining. DC resistance rise may be a function of the glass layer resistance and the steam quality.

Perhaps the most common alkali metal silicate is sodium silicate, or more formally, sodium metasilicate $Na_2SiO_3$. Sodium silicate is obtained industrially by roasting silica sand and is relatively economical and environmentally suitable for introduction into hydrocarbon reservoirs. A bench top demonstration of silica glass coating may be performed by dipping a sufficiently heated nail into a 30 percent sodium silicate water solution. As the nail is quenched a snapping noise may be heard and when withdrawn the nail will be frosted with silica glass. A soldering iron tip may similarly be frosted.

The polarity of the DC source 32 may be reversed periodically to reduce electrolytic corrosion of one subterranean pipe relative another. Otherwise the positive polarity pipe may become a sacrificial anode, as will be appreciated by those skilled in the art.

A brief theory of the electrical heating mechanisms is as follows. When DC electric currents are applied to the electrically conductive member 23 conducted electrical currents flow in the subterranean formation 21, due to connate water. The water heats due to electric resistance heating, e.g. joule effect. Static (DC) electric magnetic and electric fields may have no heating effect. Application of radio frequency electric currents to the electrically conductive member 23 can heat the connate water by multiple mechanisms.

When RF electric currents are applied to the electrically conductive member 23 magnetic near fields from the electrically conductive member 23 can heat the subterranean formation 21 by induction of eddy electric currents into the subterranean formation. Magnetic fields may cause electric currents to flow according to Lents Law. In a sense, the pipes are akin to a transformer primary winding and the subterranean formation akin to a lossy secondary winding, although physical transformer windings are not present. This advantageously may provide electric resistance heating in the subterranean formation 21 without the need for direct electrical contact with the subterranean formation.

Electric near fields from the electrically conductive member 23 can heat the subterranean formation 21 by displacement current, e.g. the electrically conductive member 23 can capacitively couple electric current into the subterranean formation 21. The pipes are akin to capacitor plates in a sense. This advantageously provides electric resistance heating in the subterranean formation 21 without physical electrical contact with the subterranean formation 21.

Both electric near fields and far fields (radio waves) may cause dielectric heating of the materials in the subterranean formation 21. Again, this provides heating in the subterranean formation 21 without physical electrical contact with the subterranean formation 21.

Advantageously, the method of the present embodiments provides increased insulation of the electrically conductive member 23 and may be particularly advantageous for start-up of a wellbore. In particular, start-up heating is provided by resistive pipe heating followed by RF induction heating. The solidification of the solidifiable material 34 advantageously provides insulation to provide increased stabilization of the wellbore 22. This in turn, may provide a more optimal electrical resistance and increased penetration of RF heating energy. Thus, RF heating efficiency may be increased. Of course, other and/or additional methods of increasing the efficiency of hydrocarbon resource recovery may be used in conjunction with the embodiments described herein, for example, the methods described in application Ser. No. 13/451,130, assigned to the present assignee, and the entire contents of which are herein incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method for forming a radio frequency (RF) radiator in a laterally extending wellbore in a subterranean formation containing a hydrocarbon resource, the method comprising:

positioning an electrically conductive member within the laterally extending wellbore;

supplying a solidifiable material within the laterally extending wellbore adjacent the electrically conductive member; and solidifying the solidifiable material within the laterally extending wellbore by supplying direct current (DC) power to the electrically conductive member to form a dielectric material layer over the electrically conductive member to form the RF radiator to be electrically insulated from the subterranean formation.

2. The method of claim 1, further comprising further electrically conductive members defining a plurality of electrically conductive members; and wherein solidifying comprises solidifying the solidifiable material by supplying direct current (DC) power to at least one of the plurality of electrically conductive members.

3. The method of claim 1, wherein the electrically conductive member comprises a well pipe.

4. The method of claim 1, wherein the electrically conductive member comprises a well pipe and an electrical conductor extending along the well pipe; and wherein solidifying comprises solidifying the solidifiable material by supplying direct current (DC) power to the electrical conductor.

5. The method of claim 1, wherein solidifying comprises solidifying the solidifiable material by positioning a catalyst into the laterally extending wellbore.

6. The method of claim 1, wherein solidifying comprises solidifying an alkali metal silicate.

7. The method of claim 1, wherein solidifying comprises solidifying at least one of sodium silicate, magnesium silicate, and potassium silicate.

8. The method of claim 1, further comprising supplying RF power to the RF radiator to heat the hydrocarbon resource.

9. The method of claim 1, further comprising recovering the hydrocarbon resources from the subterranean formation after solidifying the solidifiable material.

10. A method for forming a radio frequency (RF) radiator in a laterally extending wellbore in a subterranean formation containing a hydrocarbon resource, the method comprising:

supplying an alkali metal silicate within the laterally extending wellbore adjacent an electrically conductive member positioned within the laterally extending wellbore;

solidifying the alkali metal silicate within the laterally extending wellbore by supplying direct current (DC) power to the electrically conductive member to form a dielectric material layer over the electrically conductive member to form the RF radiator to be electrically insulated from the subterranean formation; and supplying RF power to the RF radiator to heat the hydrocarbon resource.

11. The method of claim 10, further comprising further electrically conductive members defining a plurality of electrically conductive members; and wherein solidifying comprises solidifying the alkali metal silicate by supplying direct current (DC) power to at least one of the plurality of electrically conductive members.

12. The method of claim 10, wherein solidifying comprises solidifying the alkali metal silicate by positioning a catalyst into the laterally extending wellbore.

13. The method of claim 10, wherein solidifying comprises solidifying at least one of sodium silicate, magnesium silicate, and potassium silicate.

14. A method for forming a radio frequency (RF) radiator in a subterranean formation containing a hydrocarbon resource and connate water, the method comprising:

forming a laterally extending wellbore in the subterranean formation;

positioning a well pipe within the laterally extending wellbore;

supplying a solidifiable material within the laterally extending wellbore adjacent the well pipe; and solidifying the solidifiable material within the laterally extending wellbore by supplying direct current (DC) power to the electrically conductive member to form a dielectric material layer over the well pipe to form the RF radiator to be electrically insulated from the subterranean formation.

15. The method of claim 14, wherein solidifying comprises solidifying the solidifiable material by positioning a catalyst into the laterally extending wellbore.

16. The method of claim 14, wherein solidifying comprises solidifying an alkali metal silicate.

17. The method of claim 14, wherein solidifying comprises solidifying at least one of sodium silicate, magnesium silicate, and potassium silicate.

18. The method of claim 14, further comprising supplying RF power to the RF radiator to heat the hydrocarbon resource.

* * * * *